US007297310B1

(12) United States Patent
Peng et al.

(10) Patent No.: US 7,297,310 B1
(45) Date of Patent: Nov. 20, 2007

(54) MANUFACTURING METHOD FOR ALUMINUM MATRIX NANOCOMPOSITE

(75) Inventors: Jack Y. Peng, Westlake Village, CA (US); Mark van den Bergh, Los Angeles, CA (US); William C. Harrigan, Jr., Northridge, CA (US)

(73) Assignee: DWA Technologies, Inc., Chatsworth, CA (US)

( * ) Notice: Subject to any disclaimer, the term of this patent is extended or adjusted under 35 U.S.C. 154(b) by 62 days.

(21) Appl. No.: 10/738,275

(22) Filed: Dec. 16, 2003

(51) Int. Cl.
*B22F 3/02* (2006.01)

(52) U.S. Cl. ..... 419/19; 419/66

(58) Field of Classification Search ..... 419/38, 419/19

See application file for complete search history.

(56) References Cited

U.S. PATENT DOCUMENTS 4,283,465 A * 8/1981 Morimoto et al. ..... 428/566
4,557,893 A 12/1985 Jatkar et al.
4,623,388 A 11/1986 Jatkar et al.
4,722,751 A * 2/1988 Akechi et al. ..... 75/232
4,915,605 A * 4/1990 Chan et al. ..... 419/6
4,946,500 A * 8/1990 Zedalis et al. ..... 75/232
5,039,476 A * 8/1991 Adachi et al. ..... 419/13
5,183,631 A * 2/1993 Kugimiya et al. ..... 419/10
5,498,393 A * 3/1996 Horimura et al. ..... 419/28
5,525,292 A * 6/1996 Nakao et al. ..... 419/45
5,561,829 A * 10/1996 Sawtell et al. ..... 419/13
5,902,943 A * 5/1999 Schaffer et al. ..... 75/249
6,312,643 B1 * 11/2001 Upadhya et al. ..... 419/33
6,761,852 B2 * 7/2004 Yeo et al. ..... 419/37
6,848,163 B2 * 2/2005 Bampton et al. ..... 29/508
6,902,699 B2 * 6/2005 Fritzemeier et al. ..... 419/38
2004/0137218 A1 * 7/2004 Lui et al. ..... 428/328

* cited by examiner

*Primary Examiner*—George Wyszomierski
(74) *Attorney, Agent, or Firm*—Thomas I. Rozsa; Tony D. Chen

(57) ABSTRACT

A simple method to produce Aluminum Metal Matrix Nanocomposite with 2 to 35 volume percent of nano $Al_2O_3$ reinforcement phase without adding nano $Al_2O_3$ particles in a direct step of the metal matrix. The initial necessary material is an aluminum powder with nanoscale surface oxide. The volume percent of $Al_2O_3$ is determined by the particle size distribution and the thickness of the $Al_2O_3$ layer. The $Al_2O_3$ surface layers or shells are broken up and are uniformly distributed throughout the nanocomposite after the powder consolidation into billet and the hot and/or cold metal working of the billet.

38 Claims, 1 Drawing Sheet

MANUFACTURING METHOD FOR ALUMINUM MATRIX NANOCOMPOSITE

BACKGROUND OF THE INVENTION

1. Field of the Invention

The present invention generally relates to the method of low cost production of aluminum metal matrix nanocomposites. More particularly, the present invention relates to the method of manufacturing nanoscale aluminum oxide particulate reinforced aluminum.

2. Description of the Prior Art

Aluminum Metal Matrix Nanocomposites reinforced by nanoscale aluminum oxide particulates (Al-MMNC) is one type of nanocomposite. A conventional particulate reinforced Aluminum Metal Matrix Composite (Al-MMC) usually has an aluminum or aluminum alloy phase and a ceramic reinforcement phase composed of micron scale particles. Most Al-MMCs material systems in use today are reinforced with aluminum oxide ($Al_2O_3$), boron carbide ($B_4C$) and silicon carbide (SiC) particles. Ingot metallurgy (I/M) and powder metallurgy (P/M) are common methods to produce Al-MMCs. Al-MMCs have higher yield strength, stiffness and lower coefficient of thermal expansion than those of the monolithic matrix alloy.

In general, the properties of Al-MMCs are controlled by the particle size, particle distribution in the matrix and volume fraction of the reinforcement as well as the matrix alloy properties. It is found that an Al-MMC reinforced with ceramic particles possessing fine particle size have improved strength, fatigue resistance and machineability composed of Al-MMCs reinforced with coarse ceramic particles.

Optimum mechanical properties of an Al-MMC can be obtained when stable nano ceramic particulate is uniformly distributed in the aluminum matrix. This new composite is considered to be an aluminum metal matrix nanocomposite (Al-MMNC). The I/M Al-MMC manufacturing process can produce a MMC with a ceramic particle size of minimum about 20 microns.

Finer particles are different to wet and distribute uniformly in the metal matrix resulting in microporosity and poor fatigue and fracture toughness. The P/M Al-MMC process can deal with finer particles, but ceramic particles finer than 1 micron are difficult to be distributed uniformly during the mixing process resulting in particle agglomeration.

To create a uniform distribution of the nano ceramic particles, the aluminum matrix alloy powder should have a particle size close to that of the nano ceramic particle. Otherwise, the large aluminum particles are surrounded by very fine ceramic particles. Additionally, the very fine ceramic particles will also agglomerate. These agglomerations are extremely difficult to break-up during blending once they are formed and subsequent thermo-mechanical work of the resultant MMC will cause the agglomerates form "stringers" that will act as crack initiation sites in the material.

Creating a homogenous mixture of two different nano powders or one nano powder with one micron powder is extremely difficult.

High-energy ball mills as disclosed in U.S. Pat. Nos. 4,557,893 and 4,623,388 to Jatkar et al, U.S. Pat. No. 4,946,500 to Zendalis et al and U.S. Pat. No. 4,722,751 to Akechi can mix micron and submicron powders uniformly. They can also mix nano powders uniformly.

However, high-energy ball mills have very low efficiency and are very difficult to scale up for large volume production. This blending technique adds a high cost in addition to expensive nano metal powders and nano ceramic particulates.

To overcome the barrier of mixing two powders using conventional MMC processing methods, an in-situ method has been created. The reinforcing particles are synthesized in the metal matrix by chemical reactions between elements or between the element and compound during fabrication of the MMC.

A variety of in-situ processing techniques for producing a wide range of MMNCs have been developed. X. C. Tong and H. S. Fang, *Metall, Mater. Trans. A,* 29, 893 (1998), described using an in situ method to produce TiC particulate reinforced Al-MMNC. The TiC particles formed in-situ have a size of about 100 nanometers (nm) and are uniformly distributed in the aluminum matrix.

This processing requires a high cooling rate to reduce the particle size of reinforcement and to modify its distribution in the matrix. It is a major challenge to create uniformly distributed nano reinforcements via chemical reactions during MMNC production without difficult to maintain process control.

There have been no in-situ processes that can produce Al-MMCs reinforced with $Al_2O_3$, $B_4C$ or SiC, whether on a micronscale or nanoscale.

SUMMARY OF THE INVENTION

The present invention is a novel and unique method of manufacturing aluminum metal matrix, nanocomposites reinforced with nanoscale aluminum oxide particles.

It is an object of the present invention to create a novel, unique, and simplified process for producing aluminum metal matrix nanocomposites reinforced with nanoscale aluminum oxide particles having a controlled volume fraction and uniform distribution in the aluminum matrix.

Another object of the present invention is to provide such a technique that utilizes the $Al_2O_3$ surface layers existing on all aluminum particles as the ceramic reinforcement.

Yet another object of the present invention is to provide a method for producing Al-MMNC having unalloyed aluminum or an aluminum alloy as the metal matrix and having fine grain sizes.

Still another object of the present invention is to provide a method for producing an Al-MMNC that is heat-treatable, formable, easily machined, and weldable.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
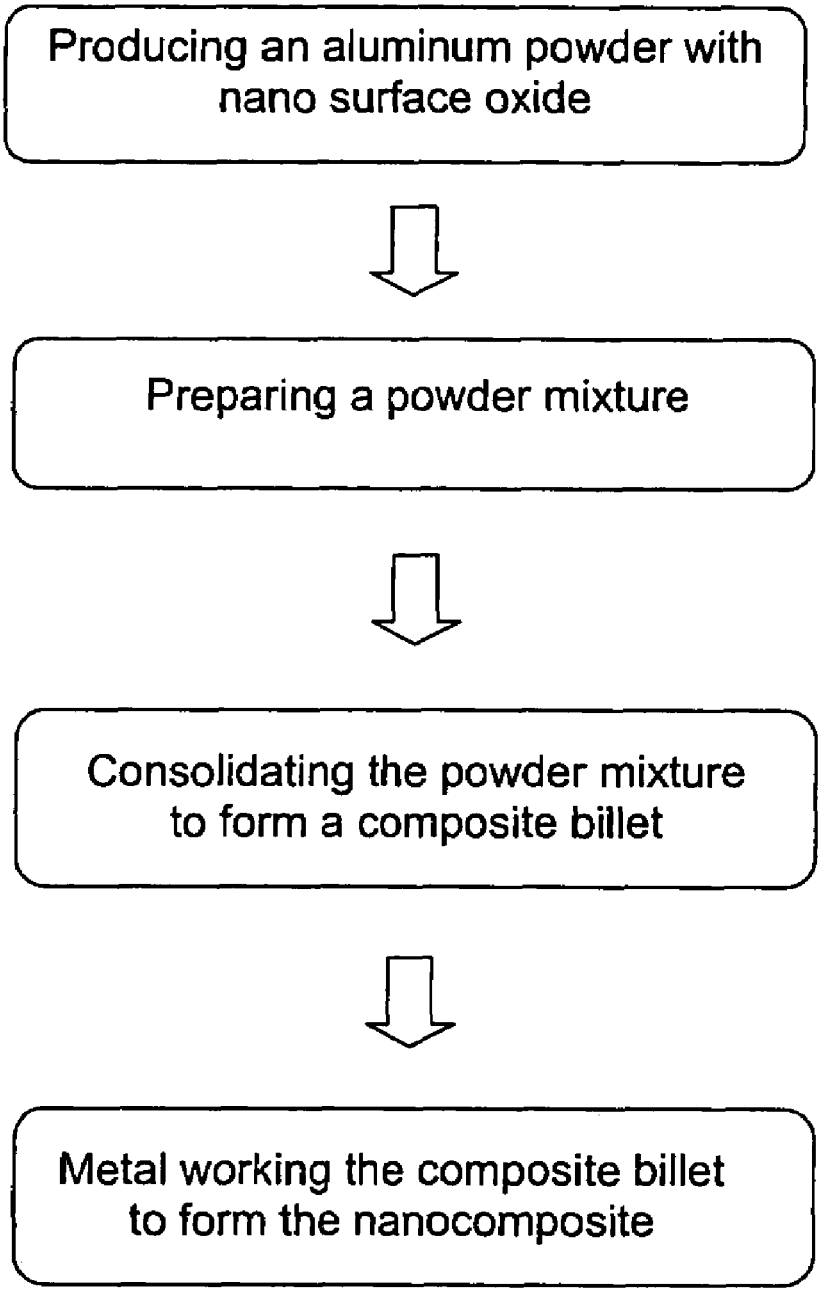
FIG. 1 is an illustrative process flow diagram of this invention.

Although specific embodiments of the present invention will now be described with reference to the drawings, it should be understood that such embodiments are by ways of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The major sequential steps of the manufacturing method of this invention are illustrated in FIG. 1, including:

Step 1. Preparing the Nano-Ceramic-Surface Aluminum Powder

In order to understand the process of producing an aluminum powder with nano surface oxide, it is necessary to understand how conventional aluminum powder is produced.

The aluminum and aluminum alloy powder can be produced by various processes including atomization, splat quenching, melt-spinning, and plasma method. Atomization, the most widely used process, can produce aluminum or aluminum alloy powder in a wide range of sizes from submicron to over 100 microns. The powder is classified into an average particle size from about 5 microns to 50 microns with normal distributions for industry applications.

The atomized aluminum particles can have shapes that go from spherical to flat particles depending on the cooling conditions. The aluminum powder for Al-MMC is usually spherical in shape. A nanoscale range of aluminum or aluminum alloy powders can be produced by the plasma method.

The aluminum or aluminum alloy powders always have an $Al_2O_3$ layer of certain thicknesses on all particles surface. All sizes of aluminum particles of the same production lot have the same thickness of $Al_2O_3$ on the particle surfaces. That is because the $Al_2O_3$ layer is formed due to the chemical reaction between aluminum and oxygen during the powder production process. The thickness of the $Al_2O_3$ layer depends on the aluminum powder manufacturing process and not the particle size. Some aluminum powder applications such as rocket engine fuel minimize the $Al_2O_3$ layer by atomizing the aluminum powder in inert gas. Aluminum powder atomized in inert gas usually has an $Al_2O_3$ surface layer of about 50 mm thickness compared to thickness of about under 100 nm for powder atomized in air.

The total percentage of $Al_2O_3$ in aluminum powder with a spherical shape is a function of the average particle size of the powder and the thickness of $Al_2O_3$ layer. The $Al_2O_3$ volume percent can be calculated by equation [1]:

$$Al_2O_3 \text{ vol } \% = 100[1-(1-2T/D)^3]\% \quad [1]$$

Where T is the thickness of the $Al_2O_3$ layer, D is the diameter of average aluminum powder particle size including the $Al_2O_3$ layer.

For a given thickness of the $Al_2O_3$ layer, the smaller average particle size, the more total $Al_2O_3$ is formed.

The volume percent of $Al_2O_3$ in an aluminum powder of irregular shape is also a function of the average particle size of the powder and the thicknesses of $Al_2O_3$ layer. The relationship among percentage of $Al_2O_3$, particle size and $Al_2O_3$ layer thickness for irregular shape aluminum powder has to be established by experimental test procedures.

Spherical shaped aluminum powder is preferred in this invention. A spherical shape has the largest surface to volume ratio, which provides the highest percentage of $Al_2O_3$ for the same volume particle.

Aluminum powder producers usually discharge aluminum powder that has very fine particle size because of the relationship between the particle size and the $Al_2O_3$ percentage. For example, the total $Al_2O_3$ volume percent is about 27% for aluminum powder that has a 2 micron average particle diameter and 100 nm thickness of surface $Al_2O_3$. The aluminum powder used in conventional Al-MMCs is about 25 micron average size with up to a 100 nm $Al_2O_3$ surface layer. It contains only up to about 2.4% $Al_2O_3$ according to the equation [1].

This invention uses the equation [1] to control producing the aluminum powder with a nano surface oxide. This invention also controls the volume percent of the $Al_2O_3$ in the final Al-MMNC.

The $Al_2O_3$ volume percent is controlled to between about 2% and 45% for most structure applications although aluminum powder with higher percentage $Al_2O_3$ can be produced.

There are three ways to control the $Al_2O_3$ volume percent in the aluminum powder:

(1) For existing aluminum powder with a fixed thickness of $Al_2O_3$ surface layer:
   (a) Determining the $Al_2O_3$ layer thickness of aluminum powder produced by an aluminum powder manufacturer. The thickness can be indirectly measured. First to measure the total $Al_2O_3$ percentage of aluminum with known average particle size. And then to calculate the thickness by equation [1].
   (b) Using (1) again to calculate the average particle size needed for producing a composite with predetermined $Al_2O_3$ vol %; and
   (c) Classifying the aluminum power to have the average particle size the same as the calculated value.

(2) For existing aluminum powder that have large average particle size:
   (a) Measuring the average particle size;
   (b) Determining the existing $Al_2O_3$ layer thickness by the method in (1)(a);
   (c) Determining the required thickness of $Al_2O_3$ layer by the equation (1) for a predetermined $Al_2O_3$ vol %; and
   (d) Increasing the $Al_2O_3$ layer thickness if the existing thickness is less than the required thickness.

The simplest way is to heat treat the aluminum powder in an air at a temperature below aluminum's melting point. A flow bed furnace is an efficient method for increasing the thickness of the $Al_2O_3$ layer. The $Al_2O_3$ thickness is controlled by the elevated temperature and the furnace time.

The $Al_2O_3$ layer needs to be thick for large average particle size. The thickness should be under 3 micron to assure that the $Al_2O_3$ shell is broken up during the powder consolidation and secondary processing steps. Aluminum powder with large average particle size should be limited to produce Al-MMNCs with low $Al_2O_3$ volume percent loadings.

(3) Use plasma method to produce nano size ranges of aluminum powder that have high volume percent of aluminum oxide:

Plasma is an efficient method to produce nano aluminum powder. Because of very small average particle size, nano aluminum with a very thin $Al_2O_3$ surface layer can have very high percentages of $Al_2O_3$. For example, Tetronics Limited in the United Kingdom has produced the nano aluminum powder that has a particle size in the range of 90 nm to 100 nm and contains 33 weight % (~30 vol %) of $Al_2O_3$.

Both atomization and plasma methods are able to produce unalloyed aluminum powder and aluminum alloy powder of Aluminum Association 2000, 6000 and 7000 series as well as other special alloys.

The aluminum powder with nano surface oxide layer for producing the Al-MMNCs has a preferred average particle size from about 20 nm to 50 microns with a normal particle size distribution.

(2) Step 2. Preparing Aluminum Alloy Matrix Mixture

The aluminum matrix is the aluminum alloy that is chosen as the most appropriate for a given Al-MMC or Al-MMNC application. There are two routes to prepare the aluminum matrix alloy.

(1) Aluminum alloy powder with nano surface oxide:

By following the procedure in Step 1, the aluminum alloy powder with predetermined percentage nano surface oxide can be produced by using a desired aluminum alloy ingot. Such aluminum alloy powder is ready for the consolidation step.

(2) Mixing alloy elemental powders with an unalloyed aluminum powder with nano surface oxide:

Step 2(1) is the simplest way. However, most aluminum powder producers are manufacturing unalloyed aluminum powder only. The powder metallurgy method of creating aluminum alloy is employed when the unalloyed aluminum powder with nano surface oxide is used.

The unalloyed aluminum powder and alloy elemental powders are mixed by using a blender, jet mill or ball mill. The alloy powders need to be reasonably uniformly mixed with unalloyed aluminum powder because the alloy elements defuse in the matrix to form the aluminum alloy during the hot consolidation process. The aluminum matrix is alloyed uniformly when such diffusion controlled-alloying is taking place.

The alloy elemental powders are selected from the group consisting of magnesium, copper, iron, zinc, manganese, nickel, cobalt, silicon, titanium, alloys and combination thereof. It is preferred to have average particle sizes of alloy powders in the particle size range of the unalloyed aluminum powder.

The $Al_2O_3$ volume percent should be adjusted according to the percentage of additional alloy powder being used.

Step 3. Consolidating the Powder Mixture

The powder mixture is loaded into a billet tool and is pressed at room temperature to form a compacted mixture that has between about 50% and 95% of theoretical density. The billet tool size can be very small or sized for compacting quantities approaching about 1000 kg (2,200 lb) of powder.

There are various powder metallurgy methods that can be employed to consolidate the compacted mixture. The following are typical processes:

(1) Vacuum/Inert-gas/Air Hot-Pressing:

Under vacuum, inert-gas or air, the compacted mixture is heated to a degassing temperature range and then is held at this range for more than about one-half hour for degassing purposes. The degassing temperature range depends on the matrix metal and is typically from between about 230° C. (450° F.) and less than the lowest eutectic melt temperature of the compacted mixture. The main function of degassing is to remove $H_2O$ from the metal matrix mixture.

After the degassing period, the temperature is raised to the consolidation temperature, which is the highest eutectic melt temperature of the compacted mixture. The consolidation temperature is lower than the aluminum melting point. The consolidation temperature is typically between about 230 and 615° C. (450 and 1145° F.). While the consolidation temperature and vacuum, inert-gas or air environment is maintained, the degassed, compacted mixture is pressed to full density resulting in a composite billet.

In the case of a thin $Al_2O_3$ layer, consolidation of the powder should take place under vacuum or inert gas to prevent additional oxidation.

(2) Cold Isostatic Press/Sinter:

In the Cold Isostatic Press (CIP)/Sinter process, the matrix mixture is compacted at room temperature in Step 3 to about 85% to 95% of theoretical density. Pressing the powder mixture to high density at room temperature requires pressures between about 50,000 psi and 85,000 psi. Typically, a Cold Isostatic Press is employed.

The compacted mixture is then sintered in vacuum, in inert-gas, or in air. The compacted mixture is heated to the degassing temperature range and then is held at this temperature range for more than about one-half hour to be degassed. After degassing, the degassed compacted mixture is heated to a sintering temperature that is the highest eutectic melt temperature of the compacted mixture so that sintering of the matrix takes place to form the composite billet. This sintered composite billet has a density that is still approximately that of the starting compacted mixture, between 85% and 95% of the theoretical density, but is sealed by the sintering process.

This sealing is needed to avoid internal oxidation of the billet during subsequent hot working. The composite will have 98% to 100% of the theoretical density after following metal working.

In the case of aluminum powders with a thin $Al_2O_3$ layer, sintering should take place under vacuum or inert gas to prevent additional oxidation.

(3) Cold Compacting/Hot Press:

In the case of aluminum powder with a thick $Al_2O_3$ layer, the matrix mixture can be consolidated without degassing since the thick $Al_2O_3$ layer prevents additional oxidization that is detrimental to the resultant composite.

The mixture is loaded into a billet tool and is pressed at room temperature to form a compacted mixture that is between about 50% and 95% of the theoretical density.

The compacted mixture is heated to the consolidation temperature in vacuum, inert-gas or in air. While the consolidation temperature and vacuum, inert-gas, or air environment continues to be maintained, the compacted mixture is hot pressed to approximately 98 to 100% of theoretical density to produce the composite billet.

Step 4. Metal Working the Composite Billet

Most of the $Al_2O_3$ surface layers are broken up during billet consolidation due to the brittle nature. Unaffected $Al_2O_3$ surface layers are broken up during cold, hot metal work, or die casting or any combination of these steps.

The cold work can be cold extrusion, cold forging, cold rolling or any combination of these steps. During hot metal working, the composite billet is plastically deformed at a temperature between about 230 and 615° C. (450 and 1145° F.), which is below the melting point of aluminum. The hot metal work can be hot extrusion, hot forging or hot rolling or any combination of these steps.

The die casting can be pressureless die casting or pressure casting. Unlike boron carbide or silicon carbide particles in conventional P/M Al/MMCs, aluminum oxide particles do not react with molten aluminum.

The metal working can be incorporated as part of fabrication processes for producing final Al-MMNC products.

After the consolidation and metal working, the $Al_2O$ surface layers of nano thickness are broken into a nano $Al_2O_3$ particulate reinforcement phase which is uniformly distributed in the aluminum matrix resulting in a homogenous aluminum metal mixture nanocomposite.

The nano $Al_2O_3$ particles also act as grain refiners that minimize the grain sizes of the aluminum alloy in the composite. As a result, the Al-MMNCs are highly ability of work hardenable to achieve higher yield strength than conventional aluminum alloys and conventional Al-MMCs.

Unlike adding reinforcing ceramic particles that contribute to impurities in the metal matrix, there are few impurities in the Al-MMNC made by the method of this invention because there is no reinforcement particle added to the aluminum matrix. Therefore, there is excellent bonding between the aluminum matrix phase and the nano $Al_2O_3$ reinforcement phase.

The nano $Al_2O_3$, excellent chemical bonding, and lower impurities in the metal matrix all contribute to a near perfect composite with significantly improved fatigue and creep resistance.

The nano aluminum oxide is less abrasive than coarse ceramic particle reinforcements. Therefore, the Al-MMNCs have better machineability than conventional Al-MMCs. The Al-MMNC is as weldable as conventional $Al_2O_3$ particulate reinforced Al-MMCs since $Al_2O_3$ does not react with the aluminum metal matrix to produce brittle components that weaken the weld zone. The Al-MMNC can be heat-treated when the matrix aluminum alloy is heat-treatable.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A method of producing a nanocomposite, comprising the steps of:

a. producing a metal powder of spherical particles with nano surface metal oxides comprised of a metal inside of said particles and a metal oxide layer on the outside of said particles of said metal powder, wherein said metal oxide layer of said spherical particles is quantitatively controlled from a volume percent of nano phase metal oxides needed in said particles, which is defined by a symbol $N_M$ and is specified by:

$$N_M = 1-(1-2\ T/D)^3,$$

where T is a thickness of the metal oxide layer, and D is an average size of said particles;

b. producing a powder mixture comprising a metal alloy element powder of particles and said metal powder of spherical particles with nano surface metal oxides;

c. having consolidating performed to said powder mixture first to form a compacted mixture comprising a metal alloy powder of spherical particles with nano surface metal oxides having said metal alloy inside of said particles and a metal oxide layer on the outside of said particles of said metal alloy powder, wherein said metal alloy powder is formed from combining said metal powder with said metal alloy element powder; said consolidating subsequently performed to said compacted mixture to form a composite billet; and d. having a metal working performed to said composite billet to form said nanocomposite, wherein said outside layer of the metal oxides of said metal alloy powder of spherical particles is broken in the processes of making said nanocomposite, and breaking of said metal oxide layer happens during said consolidation step and subsequent metal working step, and broken metal oxide layer is uniformly distributed in a metal matrix resulting in a homogenous nanocomposite.

2. The method in accordance with claim 1, wherein said nanocomposite comprises about 2 to about 45 volume percentage of metal oxides of said broken metal oxide layer.

3. The method in accordance with claim 1, wherein said nanocomposite comprises about 55 to 98 volume percentage of said metal alloy.

4. The method in accordance with claim 1, wherein said metal powder of spherical particles with nano surface metal oxides comprises said particles having a structure of a metal core and a metal oxide ceramic shell.

5. The method in accordance with claim 4, wherein said metal core is an unalloyed aluminum core.

6. The method in accordance with claim 4, wherein said metal oxide ceramic shell is an aluminum oxide shell.

7. The method in accordance with claim 4, wherein said metal oxide ceramic shell has a thickness from about 2 nanometers to about 3 micrometers.

8. The method in accordance with claim 1, wherein said metal powder of spherical particles with nano surface metal oxides has an average particle diameter from about 20 nanometers to about 50 micrometers.

9. The method in accordance with claim 1, step. b, wherein said metal alloy element powder is selected from the group consisting of magnesium, copper, iron, zinc, nickel, magnesium, cobalt, silicon, titanium, alloys and combinations thereof.

10. The method in accordance with claim 1, wherein said step "c" further comprises the steps of:

a. compacting said powder mixture in a billet tool to form a compacted mixture having a density of about 50% to about 95% of theoretical density;

b. heating said compacted mixture in a controlled environment at a degassing temperature which is less than a lowest eutectic melt temperature of said compacted mixture;

c. degassing said compacted mixture at said degassing temperature for at least about one-half hour to form a degassed compact mixture;

d. heating said degassed compacted mixture to a consolidation temperature to form a preheated degassed compacted mixture; and c. hot-pressing said preheated degassed compacted mixture to form said composite billet having a full density.

11. The method in accordance with claim 10, wherein said controlled environment is a vacuum environment.

12. The method in accordance with claim 10, wherein said controlled environment is an inert-gas environment.

13. The method in accordance with claim 10, wherein said controlled environment is an air environment.

14. The method in accordance with claim 10, wherein said consolidation temperature is a highest eutectic melt temperature of said compacted mixture.

15. The method in accordance with claim 10, wherein said consolidation temperature for said powder mixture is below the melt temperature of said metal alloy powder.

16. The method in accordance with claim 10, wherein said step "c" further comprises the steps of:

a. compacting said powder mixture to form said compacted mixture having a density of between about 85% and about 95% of theoretical density;

b. degassing said compacted mixture in said controlled environment at said degassing temperature;

c. degassing said compacted mixture at said degassing temperature for at least about one-half hour to form said degassed compacted mixture;

d. heating said degassed compacted mixture to a sintering temperature to form said composite billet having said density of between about 85% and about 95% theoretical density, wherein said sintering temperature is said highest eutectic melt temperature of said compacted mixture; and e. hot-pressing said preheated degassed compacted mixture to form said composite billet having said full density.

17. The method in accordance with claim 10, wherein said step "c" further comprises the steps of:

a. compacting said powder mixture to form said compacted mixture having said density between about 50% to about 95% of theoretical density;

b. heating said compacted mixture in said controlled environment to said consolidation temperature to form a preheated compacted mixture; and c. hot-pressing said preheated degassed compacted mixture to form said composite billet having said full density.

18. The method in accordance with claim 1, step d, wherein said metal working is a cold metal working selected from the group consisting of cold extrusion, cold forging, cold rolling and combinations thereof.

19. The method in accordance with claim 1, step. d, wherein said metal working is a hot metal working selected from the group consisting of hot extrusion, hot forging, hot rolling and combinations thereof at a temperature below said consolidation temperature.

20. The method in accordance with claim 1, step. d, wherein said metal working is a die casting.

21. The method in accordance with claim 1, wherein said metal working is a combination of cold metal working, hot metal working and die casting.

22. A method of producing a nanocomposite, comprising the steps of:

a. producing an aluminum alloy powder of spherical particles with nano surface aluminum oxides, comprised of said aluminum alloy inside of said spherical particles and an aluminum oxide layer on the outside of said spherical particles of said aluminum alloy powder, wherein said aluminum oxide layer of said spherical particles is quantitatively controlled from a volume percent of nano phase aluminum oxides needed in said particles, which is defined by a symbol $N_{A1}$ and is specified by:

$$N_{A1}=1-(1-2\ T/D)^3,$$

where T is a thickness of the aluminum oxide layer, and D is an average size of said particles;

b. having a consolidating performed to said aluminum alloy powder of spherical particles to form a compacted powder form; said consolidating subsequently performed to said compacted powder from to form a composite billet; and c. having a metal working performed to said composite billet to form said nanocomposite, wherein said outside layer of aluminum oxides of said aluminum alloy powder of spherical particles is broken in the processes of making said nanocomposite, and breaking of said aluminum oxide layer happens during said consolidation step and subsequent said metal working step, and broken aluminum oxide layer is uniformly distributed resulting in a homogenous nanocomposite.

23. The method in accordance with claim 22, wherein said nanocomposite comprises about 2 to about 45 volume percentage of aluminum oxides from said broken aluminum oxide layer.

24. The method in accordance with claim 22, wherein said nanocomposite comprises about 55 to 98 volume percentage of said aluminum alloy.

25. The method in accordance with claim 22, wherein said aluminum alloy powder of spherical particles with nano surface aluminum oxides comprises said particles having a structure of an aluminum alloy core and an aluminum oxide ceramic shell.

26. The method in accordance with claim 22, wherein said aluminum alloy powder of spherical particles with nano surface aluminum oxides has an average particle diameter from about 20 nanometers to about 50 micrometers.

27. The method in accordance with claim 25, wherein said aluminum oxide ceramic shell has a thickness from about 2 nanometers to about 3 micrometers.

28. The method in accordance with claim 22, step. a, wherein said aluminum alloy includes a metal from the group consisting of magnesium, copper, iron, zinc, nickel, manganese, cobalt, silicon, titanium, and combinations thereof.

29. The method in accordance with claim 22, wherein said step "b" further comprises the steps of:

a. compacting said aluminum alloy powder in a billet tool to form said compacted powder form having a density of about 50% to about 95% of theoretical density;

b. heating said compacted powder form in a controlled environment at a degassing temperature which is less than a lowest eutectic melt temperature of said aluminum alloy powder;

degassing said compacted powder form at said degassing temperature for at least about one-half hour to form a degassed compacted powder form;

d. heating said degassed compacted powder form to a consolidation temperature to form a preheated degassed compacted powder form; and e. hot-pressing said preheated degassed compacted mixture to form said composite billet having a full density.

30. The method in accordance with claim 29, wherein said controlled environment is a vacuum environment.

31. The method in accordance with claim 29, wherein said controlled environment is an inert-gas environment.

32. The method in accordance with claim 29, wherein said controlled environment is an air environment.

33. The method in accordance with claim 29, wherein said step "b" further comprises the steps of:

a. compacting said aluminum alloy powder to form said compacted powder form having a density of between about 85% and about 95% of theoretical density;

b. heating said compacted powder form in said controlled environment at a degassing temperature which is less than a eutectic melt temperature of said aluminum alloy powder;

c. degassing said compacted powder form at said degassing temperature for at least about one-half hour to form said degassed compacted power form;

d. heating said degassed compacted powder form to a sintering temperature to form said composite billet having said density between about 85% and about 95% of theoretical density, wherein said sintering temperature is a highest eutectic melt temperature of said aluminum alloy powder; and e. hot-pressing said preheated degassed compacted powder form to form said composite billet having said full density.

34. The method in accordance with claim 29, wherein said step "b" further comprises the steps of:

a. compacting said aluminum alloy powder to form said compacted powder form having said density between about 50% to about 95% of theoretical density;

b. heating said compacted powder form in said controlled environment to said consolidation temperature to form a preheated compacted powder form; and c. hot-pressing said preheated compacted mixture to form said composite billet having said full density.

35. The method in accordance with claim 22, step. c, wherein said metal working is a cold metal working selected from the group consisting of cold extrusion, cold forging, cold rolling and combinations thereof.

36. The method in accordance with claim 22, step. c, wherein said metal working is a hot metal working selected from the group consisting of hot extrusion, hot forging, hot rolling and combinations thereof at a temperature below said consolidation temperature.

37. The method in accordance with claim 22, step. c, wherein said metal working is a die casting.

38. The method in accordance with claim 22, step. c, wherein said metal working is a combination of cold metal working, hot metal working and die casting.

* * * * *